United States Patent [19]

Christianson

[11] Patent Number: 4,747,244

[45] Date of Patent: May 31, 1988

[54] BIN CAP OPERABLE FROM THE GROUND

[76] Inventor: Glenes O. Christianson, P.O. Box 182, Spicer, Minn. 56288

[21] Appl. No.: 18,931

[22] Filed: Feb. 25, 1987

[51] Int. Cl.[4] ..... E04N 7/22; E04N 7/30; B65D 43/26

[52] U.S. Cl. ..... 52/192; 49/357; 220/262; 220/264; 220/345

[58] Field of Search ..... 52/192, 198, 199; 49/357, 347, 345, 279, 344, 339; 220/262–264, 320, 345, 346

[56] References Cited

U.S. PATENT DOCUMENTS

| | | | |
|---|---|---|---|
| 938,475 | 11/1909 | Goethel | 49/357 X |
| 1,289,074 | 12/1918 | Armagost | 49/357 X |
| 3,733,750 | 5/1973 | Hege | 52/192 X |
| 3,733,764 | 5/1973 | Hege | 52/192 |
| 4,208,839 | 6/1980 | Candy, Sr. | 49/344 |
| 4,267,936 | 5/1981 | Pavlicek | 220/262 |
| 4,327,522 | 5/1982 | Meadows | 49/357 X |
| 4,598,496 | 7/1986 | Van Deale | 49/357 |
| 4,625,888 | 12/1986 | Thompson | 220/262 |

FOREIGN PATENT DOCUMENTS

| | | | |
|---|---|---|---|
| 1083771 | 8/1980 | Canada | 49/357 |
| 1380712 | 10/1964 | France | 49/347 |

*Primary Examiner*—David A. Scherbel
*Assistant Examiner*—Richard E. Chilcot, Jr.

[57] ABSTRACT

A device for closing and opening the cover on the top of a grain bin. The closing device includes a cap hinged to the bin and having a linkage connected to the cap; the linkage being operable from a location on the ground adjacent the bin.

3 Claims, 1 Drawing Sheet

BIN CAP OPERABLE FROM THE GROUND

BACKGROUND AND SUMMARY OF THE INVENTION

This invention pertains to opening grain bins for the storage of feed grains and more particularly to such a bin having an opening in its top and a closure for that opening which may be operated from ground level.

Feed grains, especially such grains as corn or milo are frequently stored from harvest for periods approaching twelve months and occasionally longer. Because these grains are frequently harvested while their moisture content is above the highest level for best storage, the grains are usually run through a dryer, but even after drying there is still a moisture content which may cause the grains to ferment. One of the best ways to prevent fermentation is to provide adequate ventilation.

Ventilation is frequently provided by causing ambient air to flow through the stored grains. In order to do this, an opening is formed in the top of the bin and provision is made for air to enter the bottom of the bin. This latter provision may be simply openings to allow air to enter and for natural convection to provide the circulating force; or a fan may be used to blow air through the bin. In either case, there must be a vent on the top of the bin for discharge of the air.

However there may be occasions when it is important that the top vent be closed; for example when the contents of the bin are relatively dry and the weather is inclement, it might be desirable to keep rain or snow out of the bin. At such times, it often is an unpleasant chore to climb a ladder in order to place a cap over the vent opening. It would be far easier to use a mechanism operable from ground level.

By my invention I provide such a mechanism. My device may be manually operated from adjacent the bin at ground level and provides positive movement for the cap both to open and to close the vent.

FIGURES

Figure 1:
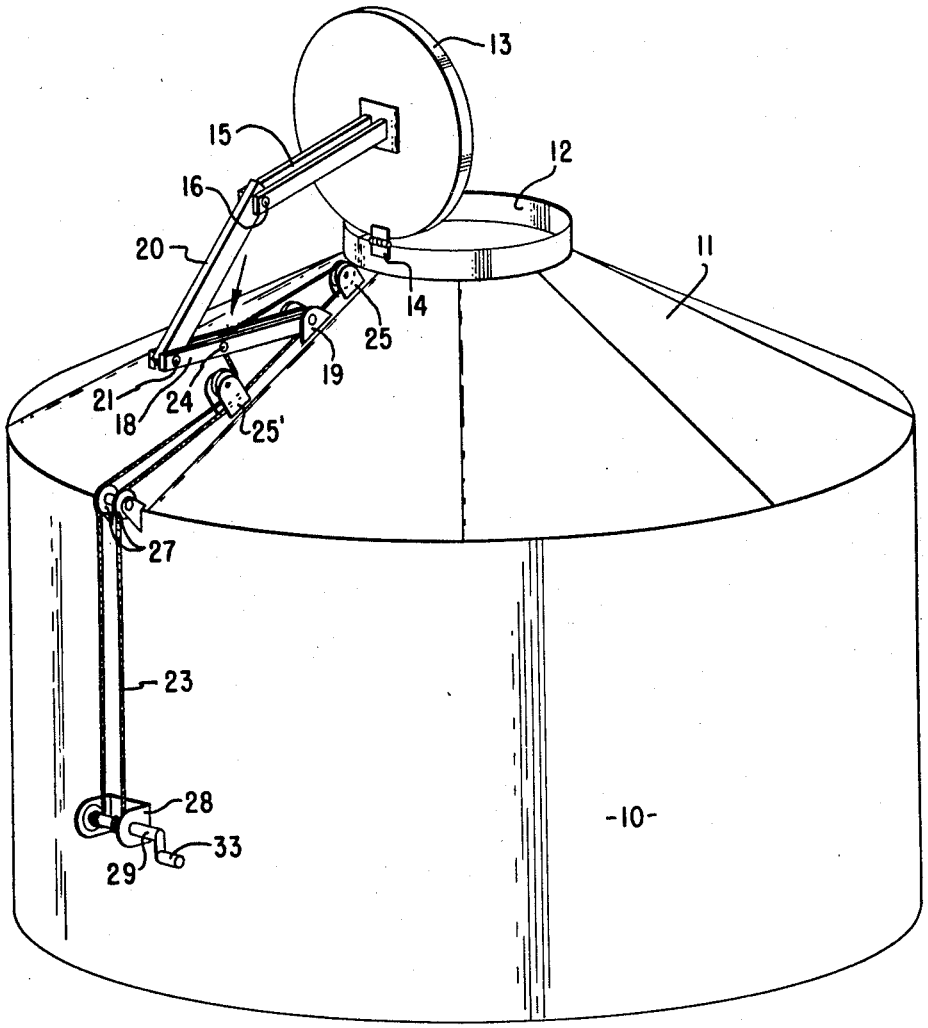
Figure 3:
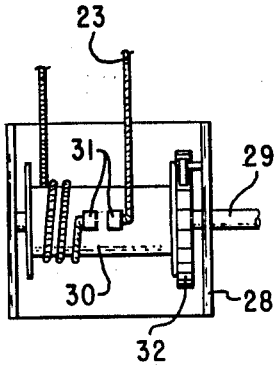
Figure 2:
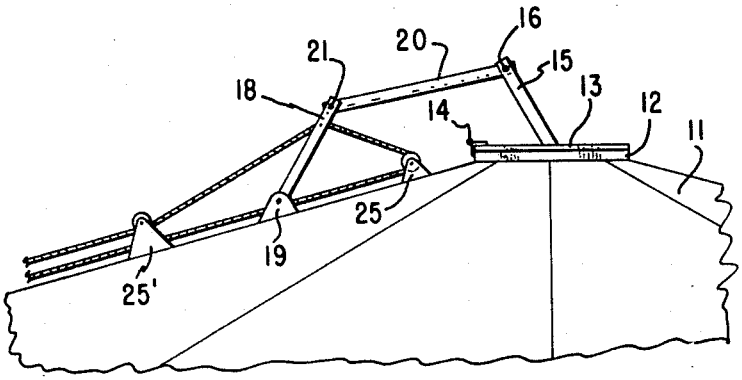

FIG. 1 is a pictorial view of my device in place on a grain bin, showing the cap in an open position, FIG. 2 is a detailed partial elevational view of the upper linkage showing the cap in a closed position, and FIG. 3 is a detailed view of the anchor means at the winch of my device.

DESCRIPTION

Briefly, my invention comprises a cap for a grain bin, the cap being operable by linkage means from ground level.

More specifically and referring to the drawings, the device is intended to be mounted on a grain bin 10 having a conical roof 11. At the apex of the roof, an opening is defined by a rim 12. It is through this opening that the ventilating air current will flow.

A cap 13 is attached to either the roof 11 or the rim 12 by a hinge 14 so that it can be pivotally moved from an open position (FIG. 1) to a closed position (FIG. 2) and back again. In order to control the movement, I provide a linkage and cable mechanism as shown in FIGS. 1 and 2.

The linkage includes an arm 15 fixed to the cap 13 and having a pin 16 providing a pivot point substantially spaced in a vertical direction from the cap 13 when the cap is closed. A similar operating arm 18 is pivoted to a bracket 19 mounted on the roof 11. A joining link 20 pivotally attached to the arms 15 and 18 by the pin 16 and a second pivot pin 21 respectively completes a linkage which will provide positive movement to move the cap 13 either to open or to close the opening.

In order to actuate the linkage, I provide a flexible line 23 which may be a rope or wire rope or even a chain or the like. This line is fixed to the link 18 at a point 24 and extends from that point over pulleys 25 and 25'. These pulleys are similar, but are mounted on the roof 11 on opposite sides of the bracket 19. Thus, the portion of line entrained over the pulley 15 tends to pull the link 18 in a direction to close the cap 13. The portion of the line running over the pulley 25' will pull the link in the opposite direction—thus tending to open the cap.

The two parts of the line are then run to the edge of the roof 11 where their direction is changed over similar pulleys 27, running thence down the side of the bin 10 to a winch 28. This winch includes a shaft 29 carrying a drum 20 to which the ends of the line 23 are fastened by clamps 31 which hold the ends of the line 23 firmly to the drum. A ratchet device 32 may be used to control the motion of the winch drum 30.

Although I illustrate the winch as operated manually by a crank 33, it will be obvious that a power operated winch could be used, and that the winch could be located higher on the bin so long as the controlling switch was located within reach from the ground. However, my preference is for the manually operated device because if the bin is located in a field away from the farmstead, power might not be readily available. Also, power outages might prevent operation of the device just at the time of inclement weather when operation is required.

I claim as my invention:

1. For a metal bin adapted to stand on the ground and having side walls, a roof on said side walls and a cap hingedly connected to said roof and adapted to cover an opening formed in said roof; a closing mechanism comprising a linkage including an arm fixed to said cap, a second arm pivotally mounted on said roof and a link pivotally connected to both arms to transmit motion from one arm to another; a rope attached to said second arm and extending in opposite directions therefrom; pulleys mounted on said roof substantially in the plane of movement of said second arm, one pulley being mounted on each side of the pivoted mounting of said second arm; said rope being entrained over said pulleys to provide positive pulling of said second arm in both directions about said pivoted mounting.

2. The device of claim 1 in which additional pulleys are mounted at the edge of said roof and a winch is mounted on said side wall, said rope being entrained over said pulleys and operably attached to said winch.

3. The device of claim 2 in which a crank on said winch provides for manual operation of said device.

* * * * *